United States Patent [19]

Nolan

[11] Patent Number: 4,616,761

[45] Date of Patent: Oct. 14, 1986

[54] VACUUM INDICATING THERMOPLASTIC CLOSURE

[75] Inventor: James F. Nolan, Sylvania, Ohio

[73] Assignee: Owens-Illinois, Inc., Toledo, Ohio

[21] Appl. No.: 673,063

[22] Filed: Nov. 19, 1984

[51] Int. Cl.[4] ..... B65D 41/04

[52] U.S. Cl. ..... 215/271

[58] Field of Search ..... 215/271, 276, 344

[56] References Cited

U.S. PATENT DOCUMENTS

| | | | |
|---|---|---|---|
| 933,347 | 9/1909 | Schmitt | 215/271 |
| 2,034,739 | 3/1936 | Bodor | 215/271 X |
| 3,062,396 | 11/1962 | Foss et al. | 215/271 |
| 3,160,302 | 12/1964 | Chaplin | 215/271 |
| 3,414,151 | 12/1968 | Morrison | 215/344 |
| 3,836,033 | 9/1974 | Podesta | 215/276 X |
| 3,888,378 | 6/1975 | Gerk | 215/344 |
| 4,093,094 | 6/1978 | Smalley et al. | 215/276 |

*Primary Examiner*—Donald F. Norton

*Attorney, Agent, or Firm*—John R. Nelson

[57] ABSTRACT

A vacuum indicating thermoplastic closure for a container for the packaging of a vacuum packed product, the top panel of the closure containing a circular inner portion which is connected to an outer annular portion by an inner annular portion with a circular hinge between the circular inner portion and the inner annular portion and another circular hinge between the inner annular portion and the outer annular portion to permit the circular inner portion to be moved relative to the outer annular portion from a first dimensionally stable position which indicates the presence of a vacuum in the associated container to a second dimensionally stable position which indicates the absence of a vacuum in the container without developing substantial tensile stresses in the top panel of the closure when the circular inner portion is in either such position. Also, a package consisting of a container, a vacuum packed product contained in the container and such a closure in sealing and closing engagement with the container.

20 Claims, 6 Drawing Figures

VACUUM INDICATING THERMOPLASTIC CLOSURE

BACKGROUND OF THE INVENTION

This invention relates to a closure for a container for the packaging of a vacuum packed product. More particularly, the invention relates to a vacuum indicating closure for a container for the packaging of vacuum packet product. Even more particularly, the invention relates to a closure which is formed from a thermoplastic material and which is of a vacuum indicating character when used on a container containing a vacuum packed product.

Many food products which are packaged in glass jars are packaged under a partial vacuum to prevent spoilage or to preserve flavor, and it is important that the closure for such a container be able to seal the container properly to maintain the vacuum in the container until the first opening thereof. It has also been recognized that it is desirable for a closure for a container for a vacuum packed product to incorporate means which will indicate the presence or absence of the desired degree of vacuum, and the prior art is familiar with metal closures which incorporate such a feature. For example, U.S. Pat. No. 4,093,094 (Smalley, et al.) describes a home canning closure in which the metal lid of a multi-piece closure incorporates a vacuum indicating button. The button in such a closure is deflected downwardly by the presence of a suitable degree of partial vacuum in the associated container, and because of the inherent elasticity of the closure, the deflected button will pop up to its normal position upon the release of the vacuum and the resulting repressurization of the container.

The use of a vacuum button or panel has heretofore been limited to metal closures or at least to closures with metal lids, however, and many of the plastic materials which have heretofore been widely utilized in the manufacture of container closures have not incorporated a similar vacuum indicating feature. The reason for this is that such plastic materials tend to be dimensionally stable only when they are under no appreciable load, and the distortion of a vacuum panel or button in the central panel of such a closure by virtue of the vacuum in the associated container would normally cause the central panel to gradually elongate (or creep) under the continued loading resulting from the vacuum. This problem could be aggravated in the case of a container exposed to abnormally high temperatures, such as, for example, those prevailing in non-air conditioned warehouses during summer months, where filled containers are somtimes stored for prolonged periods of time. In a case such as this a clear pop-up of a stressed vacuum indicating panel in a plastic closure cannot be assured.

SUMMARY OF THE INVENTION

In accordance with the present invention there is provided a closure for a container for a vacuum-packed product, which closure is made out of a thermoplastic material or at least has a central panel which is made out of a thermoplastic material. The closure central panel has an interior portion which is integrally attached to an inner annular surrounding portion by means of a thin circular region of reduced thickness, and this region acts as a hinge between the interior portion and the inner annular portion. The inner annular portion, in turn, is integrally attached to an outer annular portion by means of a second thin circular region of reduced thickness, and this second thin circular region functions as a hinge between the inner annular portion and the outer annular portion. Because of the presence of the two circular hinges in the closure, the interior portion of the closure will readily be drawn down into the headspace of the associated container by the presence of a vacuum therein, and it will indicate the presence of such vacuum by its position in a plane well below the plane of the outer annular portion of the closure. Additionally, the closure will be inherently dimensionally stable in this position because the deflected condition of the interior portion of the closure can be achieved without developing significant levels of tensile stress in any portion of the closure panel, and therefore the closure will not deform or creep to the point that the interior portion will not reliably pop up due to the repressurization of the container headspace by a loss of vacuum therein.

Accordingly, it is an object of the present invention to provide a closure for a container for the packaging of a vacuum-packed product in which at least the central panel portion of the closure is formed from a thermoplastic material and incorporates a dimensionally stable portion which is movable in response to the presence or absence of vacuum in the container to indicate such condition, and it is also an object of the present invention to provide a package comprising such a closure in sealing engagement with a container and a product packaged therein.

It is a further object of the present invention to provide a closure in which the central panel portion and depending skirt portion are molded in a single piece from a thermoplastic material and in which the central panel portion comprises an interiorly disposed portion which is movable in a dimensionally stable manner with respect to an outer annular portion when the closure is affixed to a container containing a vacuum-packed product to indicate the presence of a vacuum in the container, and it is also an object of the present invention to provide a package comprising such a molded thermoplastic closure material in seaìing engagement with a container and a product packaged therein.

For a further understanding of the present invention and the objects thereof, attention is directed to the drawing and the description thereof, to the detailed description of the invention and to the appended claims.

DETAILED DESCRIPTION OF THE INVENTION

Figure 1:
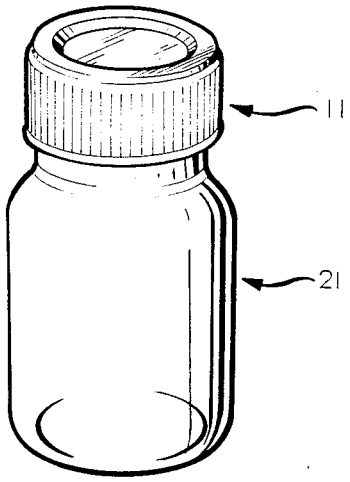
FIG. 1 is a perspective view of a container which has been closed by a closure in accordance with the present invention.
Figure 2:
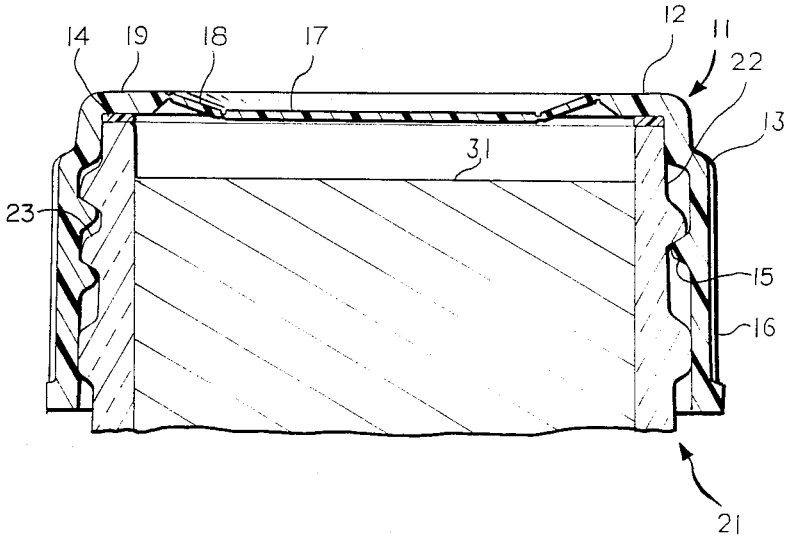
FIG. 2 is a fragmentary sectional view, at an enlarged scale relative to FIG. 1, depicting the container and the closure of FIG. 1 and a product packaged in the container.
Figure 3:
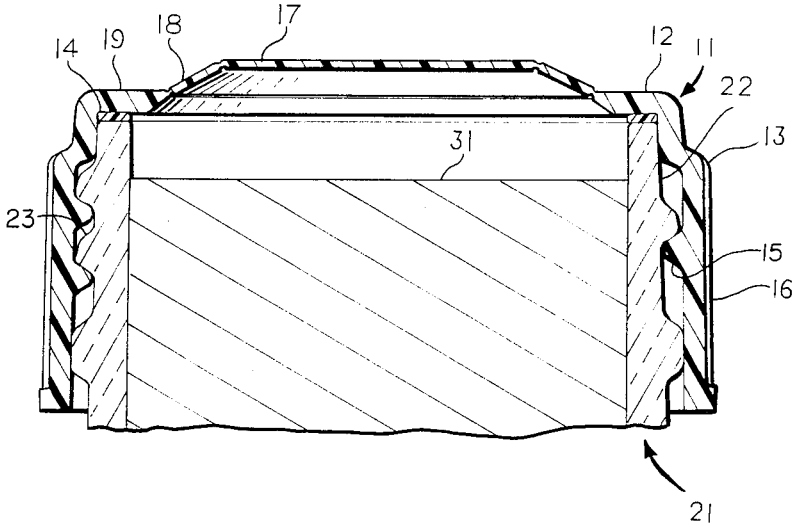
FIG. 3 is a view similar to FIG. 2 but illustrating the relationship between the container and the closure upon the loss of vacuum in the container.

As is shown in FIG. 1, a closure in accordance with the present invention, indicated generally by reference numeral 11, is shown in the closing position on a container indicated generally by reference numeral 21, which is of a type which is suitable for the packaging of a food product or other product of a type which is advantageously packaged under sub-atmospheric pressure or partial vacuum conditions to prevent spoilage or preserve flavor. Typically, the container 21 may constitute a conventional wide mouth glass container, for example, the type of container which is used in the packaging of a baby food product or a junior food product or a powdered coffee product. As is shown in FIGS. 2 and 3, container 21 is provided with a threaded neck or finish portion 22. However, it is contemplated that the closure of this invention can be utilized with containers with other types of finsihes, for example, lug type finishes and snap-on bead finishes. In any case, closure 11 is comprised of a generally horizontally disposed top portion 12, which spans the mouth of container 21, and a vertically depending annular skirt portion 13. Additionally, closure 11 is shown as comprising a sealing or gasket material 14 on the inside of top portion 12 at its juncture with skirt portion 13, and this sealing material, for example a conventional ring of a plastisol sealing compound, engages the top portion or rim of the finish 22 of the container to help maintain the desired degree of vacuum therein. Of course, it is also contemplated that the vacuum-indicating feature of closure 11, as hereinafter described in detail, can be utilized in closures of the linerless or self-sealing type, which are known in the prior art.

The depending skirt portion 13 of closure 11 is sized to pass over the rim of the finish 22 of container 21 and to extend downwardly over the thread 23 or other closure retaining means on the finish 22, and the retention is obtained by providing the inside of the depending skirt 13 of a closure 11 with means, shown as an inwardly projecting thread 15, to engage the closure retaining means 23 on the bottle, in a known manner.

Closure 11, before the insertion of gasket material 14 therein, is formed from a non-rigid thermoplastic material, for example, polypropylene or high density polyethylene, and may be readily formed in the illustrated one-piece version by injection molding or compression molding, as is well known in the art. When the closure is formed in this manner it may be provided with serrations 16 in the outside surface of skirt 13 to facilitate gripping of the closure during application and removal, and reapplication in the case of closures which are utilized on larger or multiple service containers. Where the product packaged in the associated container is oxygen sensitive, the underside of the closure may be provided with an appropriate barrier coating, not shown, or a barrier filler material may be added to the formulation of the thermoplastic material used in the manufacture of the closure.

The vacuum indicating feature of closure 11 is obtained by providing a generally planar, circular portion or closure panal portion 17 with an annular portion 18 which surrounds the circular portion 17 and another annular portion 19 which is the outermost portion of the top of the closure and which is the portion from which annular skirt 13 depends. The material at the juncture of the circular portion 17 and the annular portion 18 is thinned with respect to the thickness of such portions to form a hinge which is circular in configuration and which permits such portions to be flexed relative to one another without developing significant tensile forces in either of such portions. Similarly, the material at the juncture of annular portion 18 and annular portion 19 is thinned to form a circular hinge between these portions, and these portions may, therefore, also be flexed relative to one another without developing significant tensile stresses in either of them.

When closure 11 is in its closing position on a container 21 containing a vacuum packed product 31, as is shown in FIG. 2, the sub-atmospheric or negative pressure in the unfilled portion of the container above the top surface of product 31, which is commonly referred to as the container "headspace", will draw the circular portion 17 downwardly so that the plane of its top surface is below the plane of the top surface of annular portion 19. If the vacuum in the headspace of container 21 should be broken, for example by an opening or partial opening of closure 11 or by a seal failure due to an irregularity in the top of the container finish or an improperly formed closure gasket, the headspace will draw in air from its surroundings and will become repressurized. This increase in pressure on the underside of circular portion 17 of the top of the closure will move it or pop it upwardly into its other dimensionally stable position, as shown in FIG. 3, where the plane of the top surface of the circular portion 17 will be at a noticeably higher elevation, for example, higher than the elevation of the top surface of annular portion 19, as shown.

Preferably the closure is molded in the position depicted in FIG. 3 so that the residual stresses in the closure, sometimes referred to as the "memory" of a plastic product, will help to move it to the "up" position. Through proper warnings or instructions on the closure or the container or in associated printed materials, a consumer or a retail store employee can be advised of any dangers which are associated with the use of the package which does not contain the desired vacuum at the time of the first opening, and can be instructed to determine how to readily determine the presence or absence of such vacuum by the position of closure panel circular portion 17. Additionally, this feature can be utilized as a basis for continuous inspection of many filled containers in a packing plant where various types of electro-optical and electro-mechanical gaging equipment can be utilized to automatically read the position of closure panel circular portion 17 and to discard filled containers whose closure panel circular portions 17 are not in acceptable positions.

Figure 4:
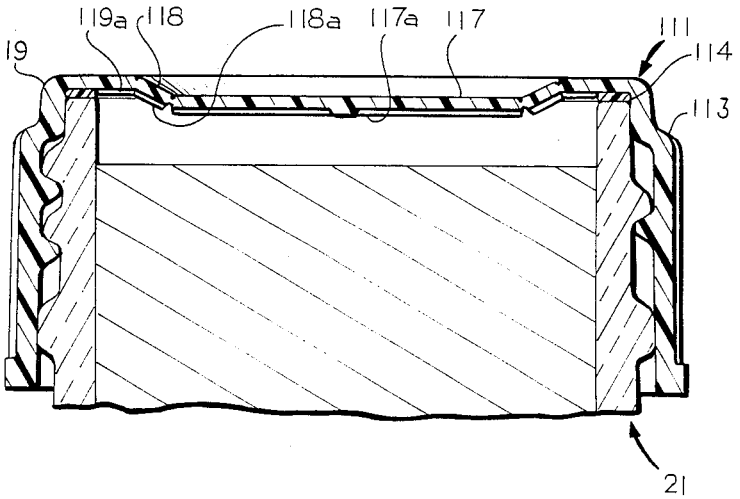
FIG. 4 is a view similar to FIG. 2 in which the closure comprises an alternative embodiment of the invention.
Figure 5:
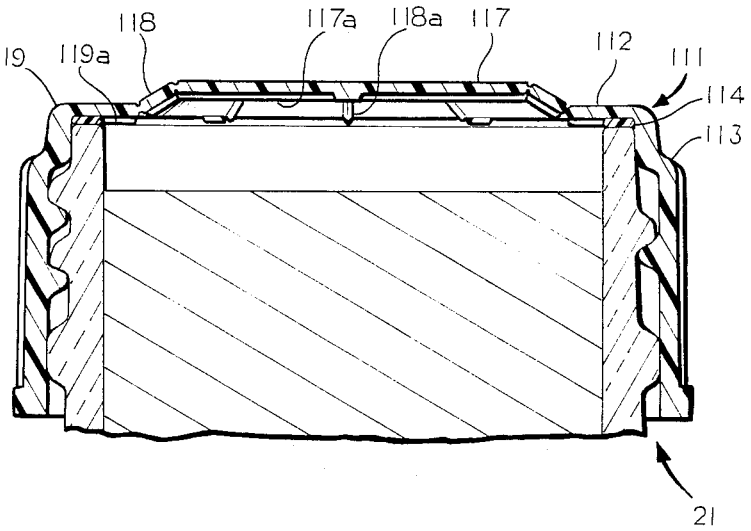
FIG. 5 is a view similar to FIG. 4 but illustrating the relationship between the container and the closure.
Figure 6:
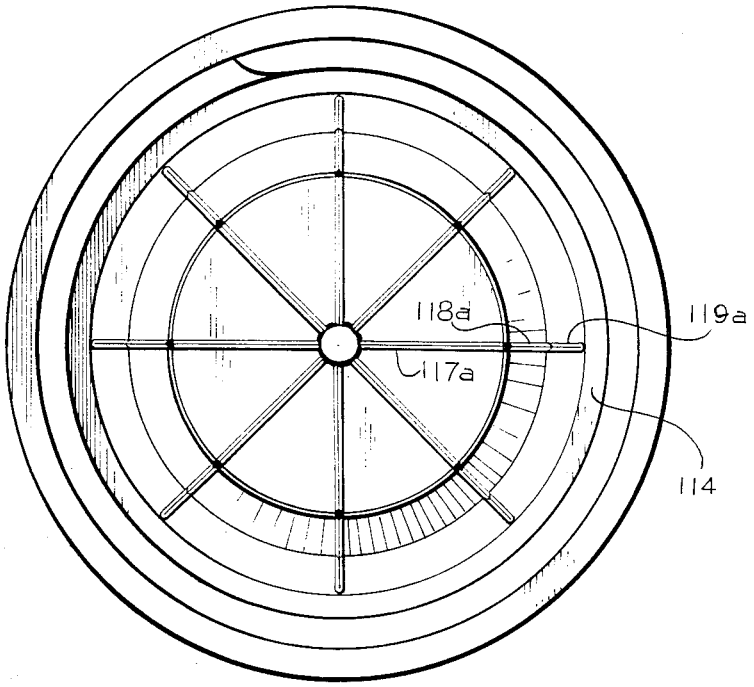
FIG. 6 is a view from the underside of the closure depicted in FIGS. 4 and 5.

The embodiment of the invention depicted in FIGS. 4–6 contains a modified embodiment of a closure, indicated generally by reference numeral 111, on a container which may be considered to be identical to that depicted in FIGS. 1–3, and which is, therefore, indicated generally by reference numeral 21. Closure 111, like closure 11, is comprised of a generally horizontally disposed top portion and a vertically depending annular skirt portion, and these portions are identified by reference numerals 112 and 113, respectively. The depending annular skirt portion 113 of closure 111 may be the same as the depending annular skirt portion 13 of closure 11, as the important differences between these embodiments of the invention lie in the differences between the construction of the top portions 12 and 112. Consequently, if it is desirable to use the gasket sealing feature of the embodiment of FIGS. 1–2 in the embodiment of FIGS. 4–6, that may be accomplished, as shown, by providing closure 111 with a suitable sealing material 114 on the inside surface of top portion 112 at its juncture with skirt portion 113.

Top portion 112 of closure 111 is provided with an interior circular portion 117 which corresponds in location and function to circular portion 17 of closure 11. Interior circular portion 117 of closure 111 differs in construction from circular portion 17 of closure 11 in that it is provided with a plurality of radially extending reinforcing ribs 117*a* on its underside to help prevent the interior circular portion 117 from bowing downwardly when it is in its downwardly situated vacuum-indicating position, as shown in FIG. 4, and from bowing upwardly when it is in its upwardly situated non-vacuum-indicating position as shown in FIG. 5.

The interior circular portion 117 of the top portion 112 of closure 111 is surrounded by an inner annular portion 118 with the material therebetween being thinned to form a circular hinge between these portions, similar to the relationship between portions 18 and 17 of closure 11, and, in turn, annular portion 118 is surrounded by another annular portion 119, again with the material therebetween being thinned to form a circular hinge between these portions to correspond to the hinged relationship between portions 19 and 18 of closure 11. As in the case of interior circular portion 117, each of annular portions 118 and 119 is provided with a plurality of radially extending ribs on its underside, and these ribs are identified by reference numerals 118*a* and 119*a*, respectively.

While all of the sets of radially extending ribs 117*a*, 118*a* and 119*a* are desirably in radial alignment with one another, as shown most clearly in FIG. 6, this is especially desirable with respect to the ribs 118*a* and 119*a* of annular portions 118 and 119, respectively, because such relationship will bring those ribs into interference contact with one another when circular portion 117 is in its downwardly situated vacuum-indicating position as shown in FIG. 5. Such an interference relationship between ribs 118*a* and 119*a* can be utilized to impart an upwardly directed biasing force on circular portion 117 to enhance the pop-up characteristics of the closure upon the loss of vacuum.

The best mode known to me to carry out this invention has been described above in terms sufficiently full, clear, concise and exact as to enable any person skilled in the art to make and use the same. It is to be understood, however, that it is within my contemplation that certain modifications of the above-described mode of practicing the invention can be made by a skilled artisan without departing from the scope of the invention and it is, therefore, desired to limit the invention only in accordance with the appended claims.

What is claimed is:

1. In combination with a container containing a vacuum-packed product therein and having a finish portion for receiving a closure to close and seal said container, a closure sealingly engaging the finish portion of said container, said closure comprising, in combination: a top portion spanning the finish of the container; and an annular skirt extending downwardly from the top portion over the upper portion of the finish and securely engaging said finish, said top portion being formed from a generally planar thermoplastic material and comprising a circular inner portion, an annular portion surrounding said circular inner portion and a second annular portion surrounding said first annular portion, said circular inner portion, said first annular portion and said second annular portion being integrally formed in one piece with the circular inner portion being hinged to said first annular portion and the first annular portion being hinged to said second annular portion, the plane of said generally planar circular inner portion being movable with respect to the plane of the second annular portion from a first dimensionally stable postion when there is a vacuum in the container to a second dimensionally stable position when there has been a loss of the desired vacuum in the container, with the second dimensionally stable position being higher in elevation than the first dimensionally stable position when the container is in its normal upright position.

2. The combination according to claim 1 in which the elevation of the first dimensionally stable position is below the elevation of the second annular portion of the top portion of the closure.

3. The combination according to claim 2 in which the elevation of the second dimensionally stable position is above the elevation of the second annular portion of the closure.

4. The combination according to claim 3 in which the top portion of the closure and the annular skirt of the closure are formed integrally with one another in one piece from said thermoplastic material.

5. The combination according to claim 4 wherein said thermoplastic material is selected from the group consisting of polypropylene and high density polyethylene.

6. The combination according to claim 5 in which the closure is formed by molding with the circular inner portion in the second dimensionally stable position during molding.

7. The combination according to claim 1 wherein the closure is provided with a sealing compound on the inside thereof adjacent the juncture of the top panel and the annular skirt and wherein the sealing compound is in sealing engagement with the finish of the container.

8. In combination with a container containing a vacuum-packed product therein and having a finish portion for receiving a closure to close and seal said container, a closure sealingly engaging the finish portion of said container, said closure comprising, in combination: a top portion spanning the finish of the container; and an annular skirt extending downwardly from the top portion over the upper portion of the finish and securely engaging said finish, said top portion being formed from a thermoplastic material and comprising a generally planar circular inner portion, said generally planar circular portion being provided with a plurality of radially extending reinforcing ribs, an annular portion surrounding said circular inner portion and a second annular portion surrounding said first annular portion, said circular inner portion, said first annular portion and said second annular portion being integrally formed in one piece with the circular inner portion being hinged to said first annular portion and the first annular portion being hinged to said second annular portion, the plane of said generally planar circular inner portion being movable with respect to the plane of the second annular portion from a first dimensionally stable position when there is a vacuum in the container to a second dimensionally stable position when there has been a loss of the desired vacuum in the container, with the second dimensionally stable position being higher in elevation than the first dimensionally stable position when the container is in its normal upright position.

9. The combination according to claim 8 wherein the underside of the first annular portion is provided with a plurality of radially extending ribs which are aligned with the radially extending ribs of the circular inner portion and wherein the underside of the second annular portion is provided with a plurality of radially extending ribs which are aligned with the radially extending ribs of the second annular portion and the radially extending ribs of the circular inner portion.

10. The combination according to claim 9 wherein the radially extending ribs of the second annular portion are in interference contact with the radially extending ribs of the first annular portion when the circular inner portion is in its first dimensionally stable position.

11. A closure for sealingly engaging the finish portion of a container containing a vacuum-packed product, said closure comprising, in combination: a top portion adapted to span the finish of the container; and an annular skirt extending downwardly from the top portion and adapted to surround the upper portion of the finish and to securely engage the finish, said top portion being formed from a thermoplastic material and comprising a generally planar circular inner portion, an annular portion surrounding said circular inner portion and a second annular portion surrounding said first annular portion, said circular inner portion, said first annular portion and said second annular portion being integrally formed in one piece with the circular inner portion being hinged to said first annular portion and the first annular portion being hinged to said second annular portion, the plane of said circular inner portion being movable with respect to the plane of the second annular portion from a first dimensionally stable position when there is a vacuum in the container to a second dimensionally stable position when there has been a loss of the desired vacuum in the container, with the second dimensionally stable position being higher in elevation than the first dimensionally stable position when the container is in its normal upright position.

12. A closure according to claim 11 in which the elevation of the first dimensionally stable position is below the elevation of the second annular portion of the top portion of the closure.

13. A closure according to claim 12 in which the elevation of the second dimensionally stable position is above the elevation of the second annular portion of the closure.

14. A closure according to claim 13 in which the top portion of the closure and the annular skirt of the closure are formed integrally with one another in one piece from said thermoplastic material.

15. A closure according to claim 14 wherein said thermoplastic material is selected from the group consisting of polypropylene and high density polyethylene.

16. A closure according to claim 15 in which the closure is formed by molding with the circular inner portion in the second dimensionally stable position during molding.

17. A closure according to claim 11 wherein the closure is provided with a sealing compound on the inside thereof adjacent the juncture of the top panel and the annular skirt and wherein the sealing compound is adapted to be in sealing engagement with the finish of the container when the closure is applied thereto.

18. A closure for sealingly engaging the finish portion of a container containing a vacuum-packed product, said closure comprising, in combination: a top portion adapted to span the finish of the container; and an annular skirt extending downwardly from the top portion and adapted to surround the upper portion of the finish and to securely engage the finish, said top portion being formed from a thermoplastic material and comprising a generally planar circular inner portion, said generally planar circular inner portion being provided with a plurality of radially extending reinforcing ribs, an annular portion surrounding said circular inner portion and a second annular portion surrounding said first annular portion, said circular inner portion, said first annular portion and said second annular portion being integrally formed in one piece with the circular inner portion being hinged to said first annular portion and the first annular portion being hinged to said second annular portion, the plane of said generally planar circular inner portion being movable with respect to the plane of the second annular portion from a first dimensionally stable position when there is a vacuum in the container to a second dimensionally stable position when there has been a loss of the desired vacuum in the container, with the second dimensionally stable position being higher in elevation than the first dimensionally stable position when the container is in its normal upright position.

19. A closure according to claim 18 wherein the underside of the first annular portion is provided with a plurality of radially extending ribs which are aligned with the radially extending ribs of the circular inner portion and wherein the underside of the second annular portion is provided with a plurality of radially extending ribs which are aligned with the radially extending ribs of the second annular portion and the radially extending ribs of the circular inner portion.

20. A closure according to claim 19 wherein the radially extending ribs of the second annular portion are in interference contact with the radially extending ribs of the first annular portion when the circular inner portion is in its first dimensionally stable position.

* * * * *